United States Patent [19]

Erickson et al.

[11] Patent Number: 5,003,938

[45] Date of Patent: Apr. 2, 1991

[54] PNEUMATICALLY POWERED VALVE ACTUATOR

[75] Inventors: Frederick L. Erickson; William E. Richeson, Jr., both of Fort Wayne, Ind.

[73] Assignee: Magnavox Government and Industrial Electronics Company, Fort Wayne, Ind.

[21] Appl. No.: 457,014

[22] Filed: Dec. 26, 1989

[51] Int. Cl.[5] ..... F01L 9/00

[52] U.S. Cl. ..... 123/90.14; 123/90.11

[58] Field of Search ..... 123/90.11, 90.12, 90.13, 123/90.14

[56] References Cited

U.S. PATENT DOCUMENTS

| | | | |
|---|---|---|---|
| 2,552,960 | 5/1951 | Grieshaber et al. | 132/90.14 |
| 4,852,528 | 8/1989 | Richeson et al. | 123/90.14 |
| 4,872,425 | 10/1989 | Richeson et al. | 123/90.14 |
| 4,873,948 | 10/1989 | Richeson et al. | 123/90.14 |
| 4,875,441 | 10/1989 | Richeson et al. | 123/90.14 |
| 4,899,700 | 2/1990 | Richeson et al. | 123/90.14 |
| 4,915,015 | 4/1990 | Richeson et al. | 123/90.14 |

FOREIGN PATENT DOCUMENTS

| | | | |
|---|---|---|---|
| 2804771 | 8/1978 | Fed. Rep. of Germany | 123/90.14 |

*Primary Examiner*—Charles J. Myhre
*Assistant Examiner*—Weilun Lo
*Attorney, Agent, or Firm*—Roger M. Rickert; Thomas A. Briody; Richard T. Seeger

[57] ABSTRACT

An electronically controllable pneumatically powered valve actuating mechanism for use in an internal combustion engine is disclosed. The engine is of the type having engine intake and exhaust valves with elongated valve stems. The actuator has a power piston reciprocable along an axis and adapted to be coupled to an engine valve and a pneumatic arrangement for moving the piston. A pneumatic damping arrangement imparts a first decelerating force to the piston when the engine valve reaches a first separation from one of said valve-open and valve-closed positions to begin reducing engine valve velocity as the engine valve approaches said one position, and imparts a second lesser decelerating force to the piston when the engine valve reaches a second lesser separation from that one position. A resilient member cooperates with and is deformed by the air control valve to prevent the application of piston moving air pressure to the piston when the air control valve is in the closed position, and included is an arrangement for adjustably selecting the amount of deformation of the resilient member when the air valve is in the closed position. An initializer to force the piston to one of its extreme positions upon start up, a pressure regulator, and an arrangement for minimizing surface tension induced valve sticking problems are also disclosed.

20 Claims, 12 Drawing Sheets

PNEUMATICALLY POWERED VALVE ACTUATOR

SUMMARY OF THE INVENTION

The present invention relates generally to a two position, bistable, straight line motion actuator and more particularly to a fast acting actuator which utilizes high fluid pressure acting on a piston to perform fast transit times between the two positions. The invention utilizes control valves to gate high pressure fluid to the piston and permanent magnets to hold the control valves in their respective closed positions until the associated one of two coils is energized to neutralize the permanent magnet latching force and temporarily open the control valve allowing the high pressure fluid to move the piston from one position to the other.

This actuator finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves. The actuator mechanism may find numerous other applications.

Internal combustion engine valves are almost universally of a poppet type which are spring loaded toward a valve-closed position and opened against that spring bias by a cam on a rotating cam shaft with the cam shaft being synchronized with the engine crankshaft to achieve opening and closing at fixed preferred times in the engine cycle. This fixed timing is a compromise between the timing best suited for high engine speed and the timing best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

For example, in U.S. patent application Ser. No. 226,418 entitled VEHICLE MANAGEMENT COMPUTER filed in the name of William E. Richeson on July 29, 1988 there is disclosed a computer control system which receives a plurality of engine operation sensor inputs and in turn controls a plurality of engine operating parameters including ignition timing and the time in each cycle of the opening and closing of the intake and exhaust valves among others. This application teaches numerous operating modes or cycles in addition to the conventional four-stroke cycle.

U.S. Pat. No. 4,009,695 discloses hydraulically actuated valves in turn controlled by spool valves which are themselves controlled by a dashboard computer which monitors a number of engine operating parameters. This patent references many advantages which could be achieved by such independent valve control, but is not, due to its relatively slow acting hydraulic nature, capable of achieving these advantages. The patented arrangement attempts to control the valves on a real time basis so that the overall system is one with feedback and subject to the associated oscillatory behavior.

U.S. Pat. No. 4,700,684 suggests that if freely adjustable opening and closing times for inlet and exhaust valves is available, then unthrottled load control is achievable by controlling exhaust gas retention within the cylinders.

Substitutes for or improvements on conventional cam actuated valves have long been a goal. In the Richeson U.S. Pat. No. 4,794,890 entitled ELECTROMAGNETIC VALVE ACTUATOR, there is disclosed a valve actuator which has permanent magnet latching at the open and closed positions. Electromagnetic repulsion may be employed to cause the valve to move from one position to the other. Several damping and energy recovery schemes are also included.

In copending application Ser. No. 153,257, now U.S. Pat. No. 4,878,464, entitled PNEUMATIC ELECTRONIC VALVE ACTUATOR, filed Feb. 8, 1988 in the names of William E. Richeson and Frederick L. Erickson and assigned to the assignee of the present application there is disclosed a somewhat similar valve actuating device which employs a release type mechanism rather than a repulsion scheme as in the previously identified U.S. Patent. The disclosed device in this application is a jointly pneumatically and electromagnetically powered valve with high pressure air supply and control valving to use the air for both damping and as one motive force. The magnetic motive force is supplied from the magnetic latch opposite the one being released and this magnetic force attracts an armature of the device so long as the magnetic field of the first latch is in its reduced state. As the armature closes on the opposite latch, the magnetic attraction increases and overpowers that of the first latch regardless of whether it remains in the reduced state or not. This copending application also discloses different operating modes including delayed intake valve closure and a six stroke cycle mode of operation.

The forgoing as well as a number of other related applications all assigned to the assignee of the present invention and filed in the name of William E. Richeson or William E. Richeson and Frederick L. Erickson are summarized in the introductory portions of copending Ser. No. 07/294,728, now U.S. Pat. No. 4,875,441, filed in the names of Richeson and Erickson on Jan. 6, 1989 and entitled ENHANCED EFFICIENCY VALVE ACTUATOR.

Many of the later filed above noted cases disclose a main or working piston which drives the engine valve and which is, in turn powered by compressed air. The power or working piston which moves the engine valve between open and closed positions is separated from the latching components and certain control valving structures so that the mass to be moved is materially reduced allowing very rapid operation. Latching and release forces are also reduced. Those valving components which have been separated from the main piston need not travel the full length of the piston stroke, leading to some improvement in efficiency. Compressed air is supplied to the working piston by a pair of control valves with that compressed air driving the piston from one position to another as well as typically holding the pistion in a given position until a control valve is again actuated. The control valves are held closed by permanent magnets and opened by pneumatic force on the control valve when an electrical pulse to a coil near the permanent magnet neutralizes the attractive force of the magnet.

In these later filed cases which disclose a main or working piston and separate control valves, a portion of the main piston cooperates with the control valves to achieve the desired control. Moreover, the cooperating portion of the main piston invariably has multiple diameters to achieve these results. Simplification of the main piston shape and the correlative reduction in the cost thereof would be highly desirable. Utilization of a straight section of such a main piston to provide piston bearing support, piston sealing and a portion of the cooperative valving would also be highly desirable.

These devices of these cases also require permanent magnets sufficiently strong to overcome the high pressure air effect on the control valve. It would be desirable to reduce the area of the control valve subjected to this high pressure air thereby reducing the air pressure force on the control valve and, therefor, also reducing the size and cost of the permanent magnet required to oppose that air pressure force.

In the devices of these applications, air is compressed by piston motion to slow the piston (dampen piston motion) near the end of its stroke and then that air is abruptly vented to atmosphere. A more controlled and gentle release of the air would tend to smooth the motion and quiet operation.

On extremely rare occasions the mechanism of these applications may be stranded in its midway position when the mechanism is turned off and some scheme for initializing, i.e., moving the piston to one of its extreme positions on start-up is desirable.

Variations in engine speed and other operating parameters take their toll on the source of compressed air and it is difficult to maintain a constant high pressure air source. It has been found that a regulator to maintain a constant ratio of the high pressure to the intermediate (latching) pressure reduces the problems of pressure source pressure variations.

Finally, it has been observed that the latch plates which, in conjunction with the permanent magnets, hold the control valves closed may tend to stick in the closed position due to the surface tension of oil being trapped in a very thin film across a large area, and, moreover, that these latch plates require some final hand adjustment relative to the control valve seal to achieve proper mechanism operation. Annular and radial relief grooves in the face of the latch plate relieves this surface tension sticking problem and provides some other unexpected benefits. An adjustable coupling between the latch plate and its control valve speeds adjustment of the mechanism.

The above noted aspects are, for lack of a better term, problem areas all of which are addressed by the present invention, and any one of which may be improved upon independent of the others to provide some measure of improvement in overall mechanism operation.

The entire disclosures of all of the above identified copending applications and patents are specifically incorporated herein by reference.

Among the several objects of the present invention may be noted the provision of a bistable transducer which implements a solution to each of the above noted problem areas; the provision of a fast acting, reliable and economical internal combustion valve actuating mechanism; the provision of a valve actuator having an adjustable latch plate; the provision of a valve actuator having a latch plate with a surface tension reducing face; the provision of a pressure ratio regulator for a pressure actuated valve actuator; the provision of an initialization routine preparatory to starting an air powered valve system; the provision of valve actuator with a piston having a three function, one diameter subpiston to either side thereof; the provision of a throttled step in pressure release of damping air in a valve actuating mechanism; and the provision of a number of different techniques to reduce the cost of a permanent magnet used to latch a control valve in a valve actuating mechanism. These as well as other objects and advantageous features of the present invention will be in part apparent and in part pointed out hereinafter.

In general, an electronically controllable pneumatically powered valve actuating mechanism for use in an internal combustion engine has a power piston reciprocable along an axis and adapted to be coupled to an internal combustion engine valve along with a pneumatic arrangement for moving the piston, thereby causing an engine valve to move between valve-open and valve-closed positions. The pneumatic arrangement includes a pair of control valves movable relative to the piston for selectively supplying high pressure air to the piston and a pneumatic damping arrangement for imparting a first decelerating force to the piston when the engine valve reaches a first separation from one of the valve-open and valve-closed positions to begin reducing engine valve velocity as the engine valve approaches that one position, and for imparting a second lesser decelerating force to the piston when the engine valve reaches a second lesser separation from that one position. This two stage damping and blow-down reduces the likelihood of damping induced oscillation or bounce of the valve at the extremes of its motion.

Also in general and according to one aspect of the invention, an electronically controllable pneumatically powered valve actuating mechanism for use in an internal combustion engine has a power piston reciprocable along an axis. The power piston is adapted to be coupled to an engine valve and has a pair of spaced apart enlarged diameter cylindrical portions for providing a sliding seal to confine high pressure air which has been supplied to the piston as well as providing a pair of sliding bearing surfaces for supporting the piston. A pneumatic arrangement supplies high pressure air to the piston causing the piston and engine valve to move in the direction of stem elongation between valve-open and valve-closed positions. A permanent magnet latching scheme, including a control valve, renders the pneumatic arrangement ineffective, but may be released allowing the pneumatic arrangement to move the control valve. The enlarged diameter cylindrical portion is also responsive to control valve motion to stop the supply of high pressure air to the piston. The air control valve includes an inner cylindrical surface which slidingly engages a portion of the outer surface of one of the enlarged diameter cylindrical portions of the power piston. This inner cylindrical surface includes a strengthened end portion of reduced inner diameter for threadedly receiving a magnetic latch plate and is too small to receive the enlarged diameter cylindrical portion of the piston.

Still further in general, a bistable electronically controlled pneumatically powered transducer has an armature which is reciprocable between first and second positions by an air pressure source and an air control valve which cooperate to cause the armature to move. A permanent magnet latching arrangement holds the air control valve in a closed position and an electromagnetic arrangement temporarily neutralizes the effect of the permanent magnet latching arrangement to open the air control valve and cause the armature to move from one position to the other. A resilient member cooperates with and is deformed by the air control valve to prevent the application of armature moving air pressure to the armature when the air control valve is in the closed position, and the amount of deformation of the resilient member when the air valve is in the closed position is adjustably selectable.

BRIEF DESCRIPTION OF THE DRAWING

Corresponding reference characters indicate corresponding parts throughout the several views of the drawing.

Figure 1:
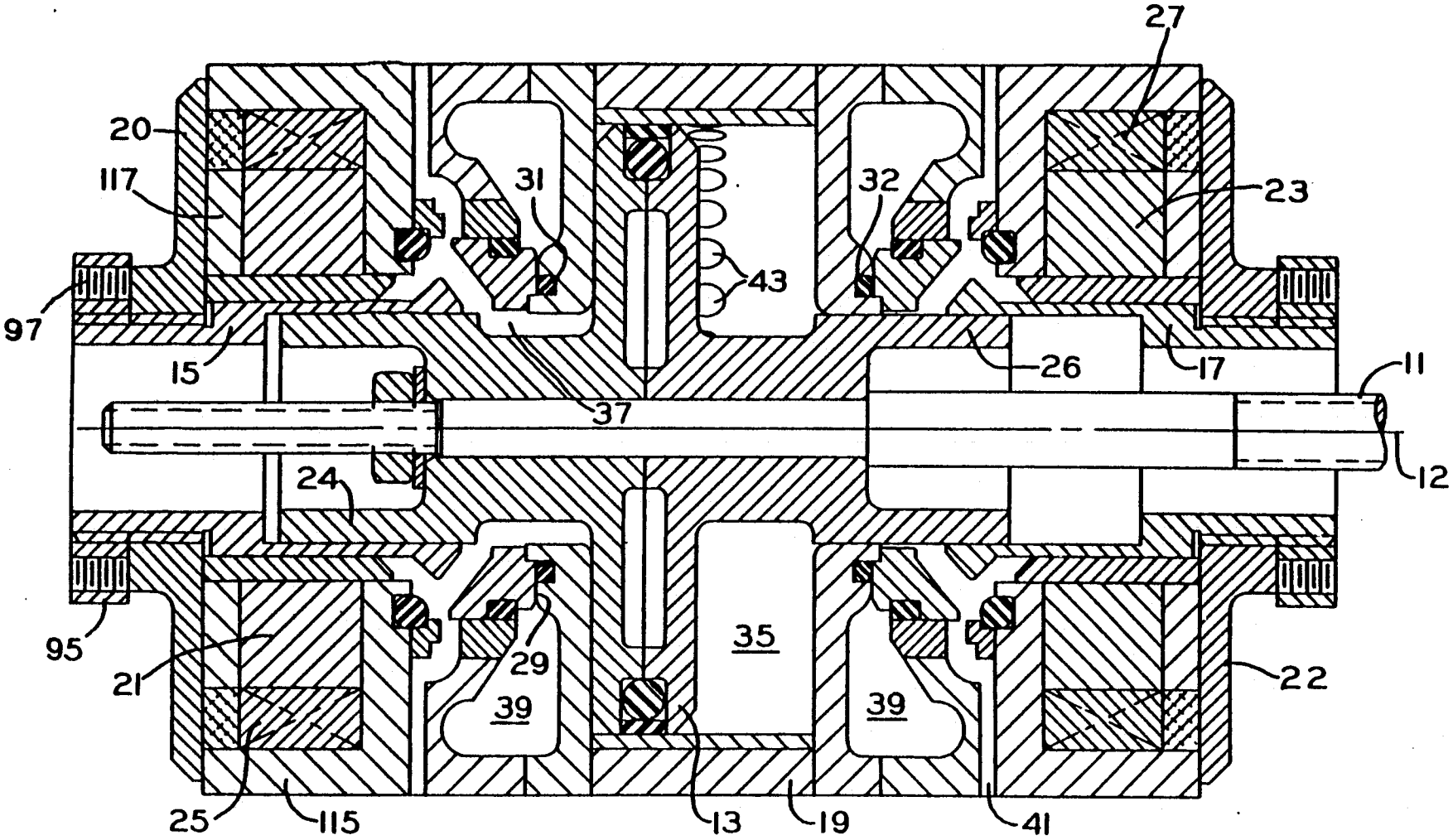
FIG. 1 is a view in cross-section of a valve actuating mechanism incorporating the invention in one form.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

The overall valve actuator is illustrated in cross-section in FIG. 1 in conjunction with which various component locations and functions in moving a poppet valve or other component (not shown) from a closed to an open position will be described. Motion in the opposite direction will be clearly understood from the symmetry of the components. The actuator includes a shaft or stem 11 which may form a part of or connect to an internal combustion engine poppet valve. The actuator also includes a low mass reciprocable piston 13, and a pair of reciprocating or sliding control valve members 15 and 17 enclosed within a housing 19. The piston and control valves reciprocate along the common axis 12. The control valve members 15 and 17 are latched in one (the closed) position by permanent magnets 21 and 23 and may be dislodged from their respective latched positions by energization of coils 25 and 27. The permanent magnet latching arrangement also includes ferromagnetic latch plates 20 and 22 which are iron or similar ferromagnetic members and are attached to and move with the air control valves 15 and 17. The control valve members or shuttle valves 15 and 17 cooperate with the cylindrical end portions 24 and 26 of piston 13 as well as with the housing 19 to achieve the various porting functions during operation. The housing 19 has a high pressure inlet port 39, a low pressure outlet port 41 and an intermediate pressure port extending from the sidewall apertures 43. The low pressure may be about atmospheric pressure while the intermediate pressure is about ten psi. above atmospheric pressure and the high pressure is on the order of 100 psi. gauge pressure.

When the valve actuator is in its initial state with piston 13 in the extreme leftward position and with the air control valve 15 latched closed, the annular abutment end surface 29 of the control valve seals against an O-ring 31. This seals the pressure in cavity 39 and prevents the application of any moving force to the main piston 13. The high pressure cavity 39 is similarly sealed by a symmetric O-ring 32. In this position, the main piston 13 is being urged to the left (latched) by the pressure in cavity or chamber 35 which is greater than the pressure in chamber or cavity 37. When it is desired to open, e.g., an associated engine intake or exhaust valve, coil 25 is energized and the current flow therein induces a magnetic field opposing the field of the permanent magnet 21. With the magnetic latching force on plate 20 thus essentially neutralized, the unbalanced force of the high pressure air against surface 29 moves the control valve 15 leftward as viewed from the position of FIG. 1 to the position illustrated in FIG. 2 where an annular opening is just beginning to form near the O-ring 31 between the control valve 15 and edge 47 of the housing 19.

Figure 2:
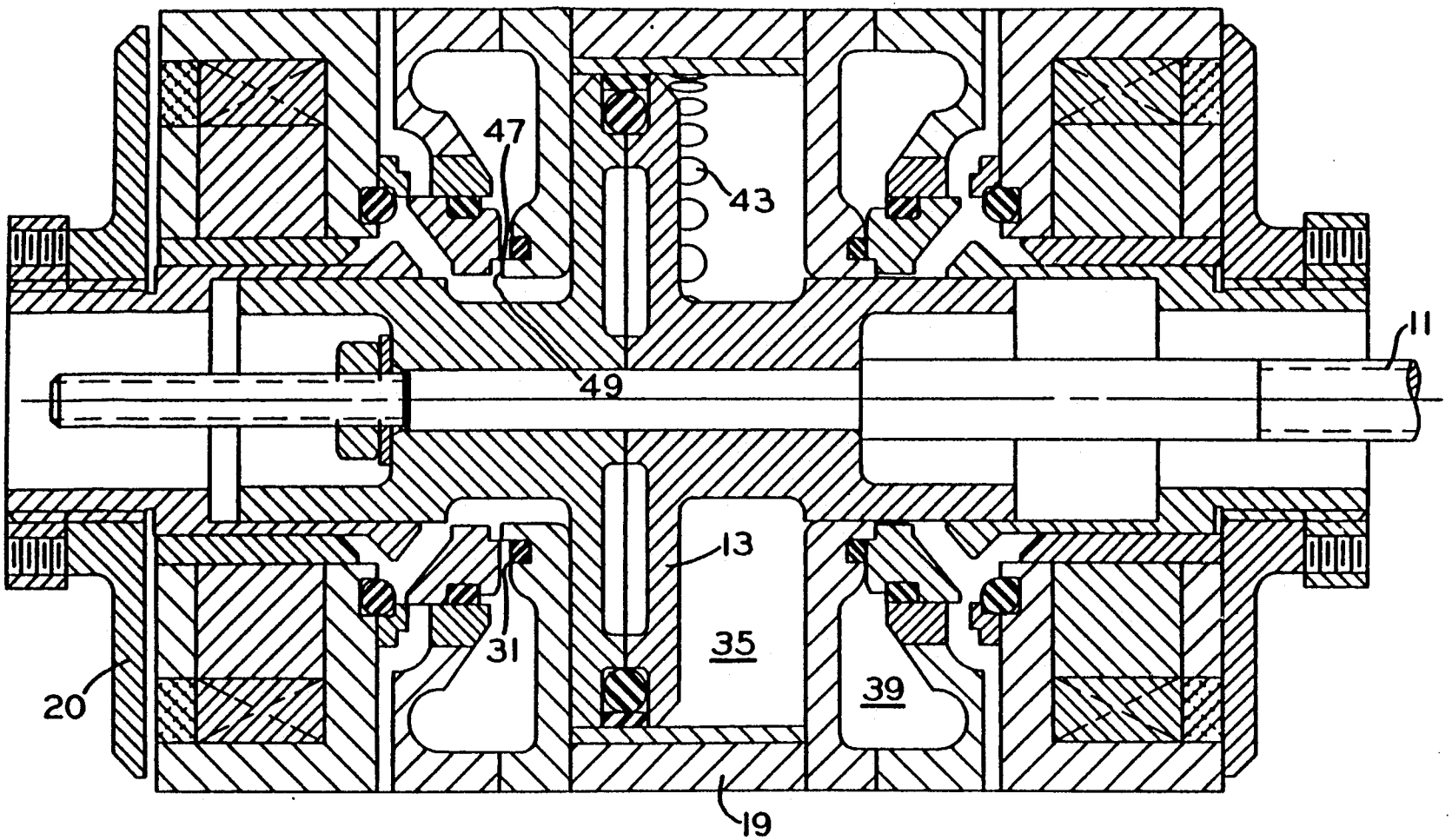
FIGS. 2-7 are views in cross-section similar to FIG. 1, but illustrating the sequential motion of the components as the piston moves from its extreme left to its extreme right position.
Figure 6:
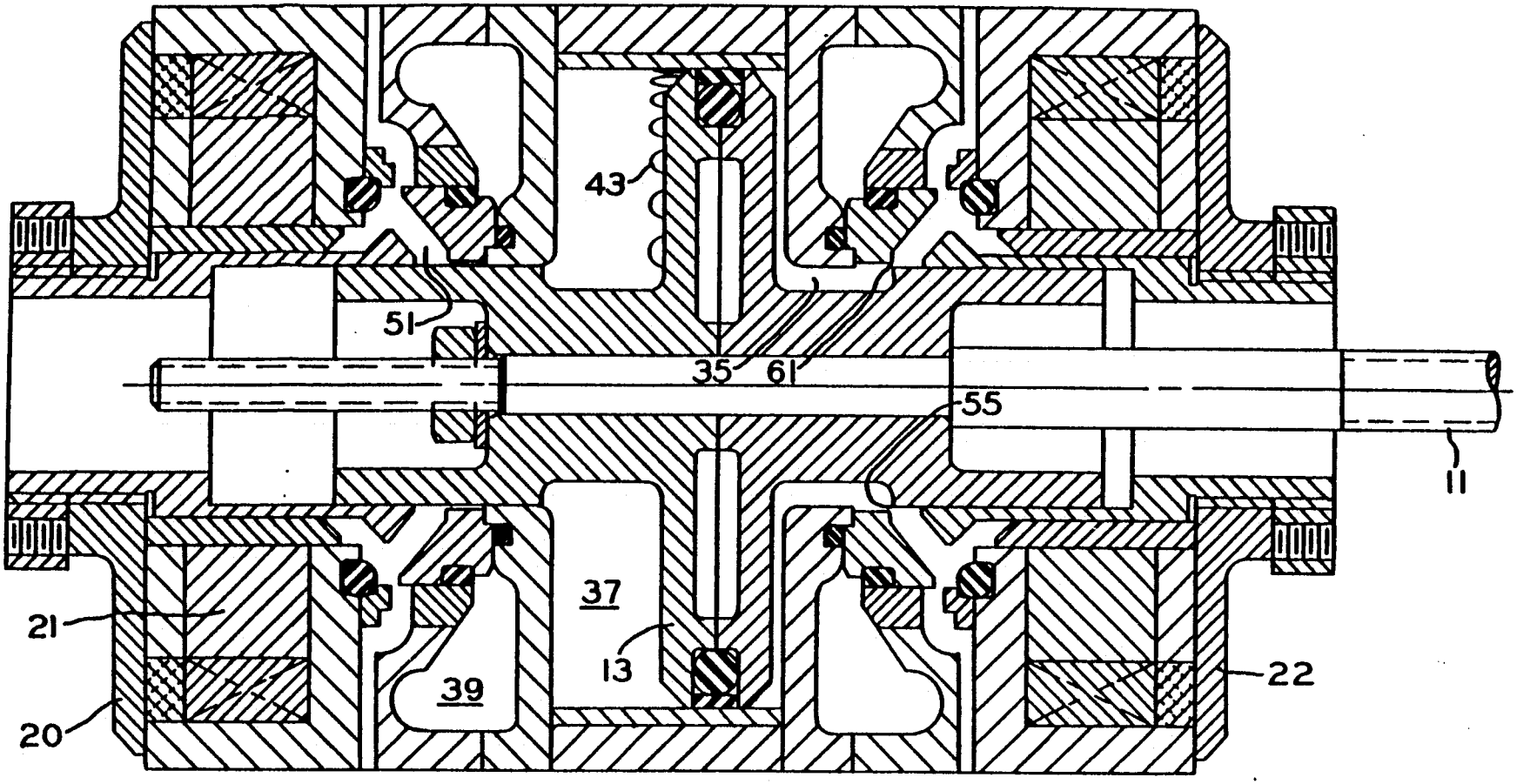
Figure 7:
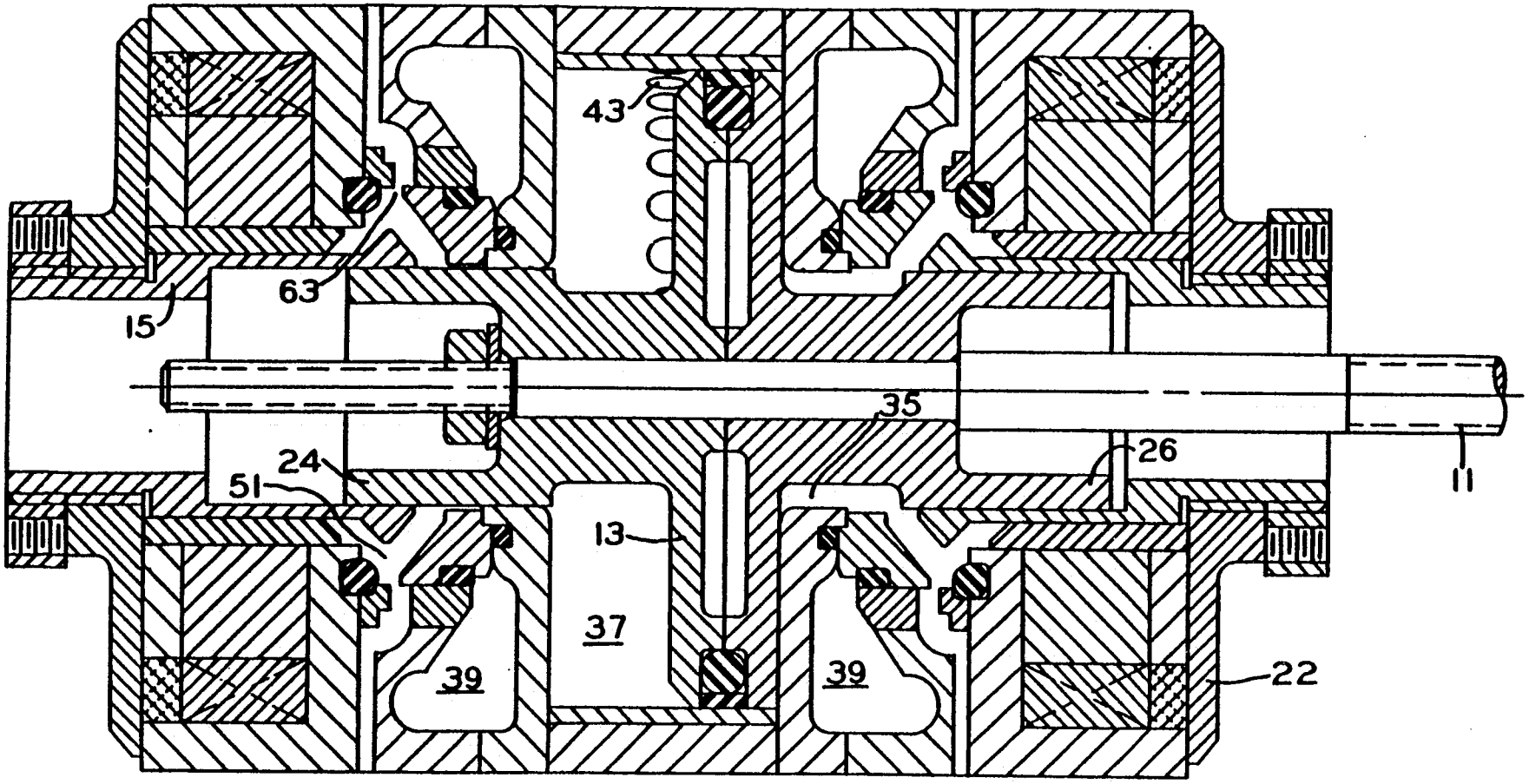

In FIGS. 1 and 2, the piston 13 has not yet moved from its leftmost position. In one illustrative embodiment, the desired engine valve opening and thus, the maximum piston movement was 0.390 inches as shown in FIG. 7. In this case, piston displacement is 0.140 inches in FIG. 3, 0.240 inches in FIG. 4, 0.320 inches in FIG. 5 and 0.350 inches in FIG. 6. Similarly, in FIGS. 1, 6 and 7, the air control valve 15 is closed and is opened 0.035 inches in FIG. 2, 0.070 inches in FIG. 3, 0.085 inches in FIG. 4, and has nearly reclosed to only 0.025 inches in FIG. 5. Such figures are illustrative and provided for comparison purposes only.

Figure 3:
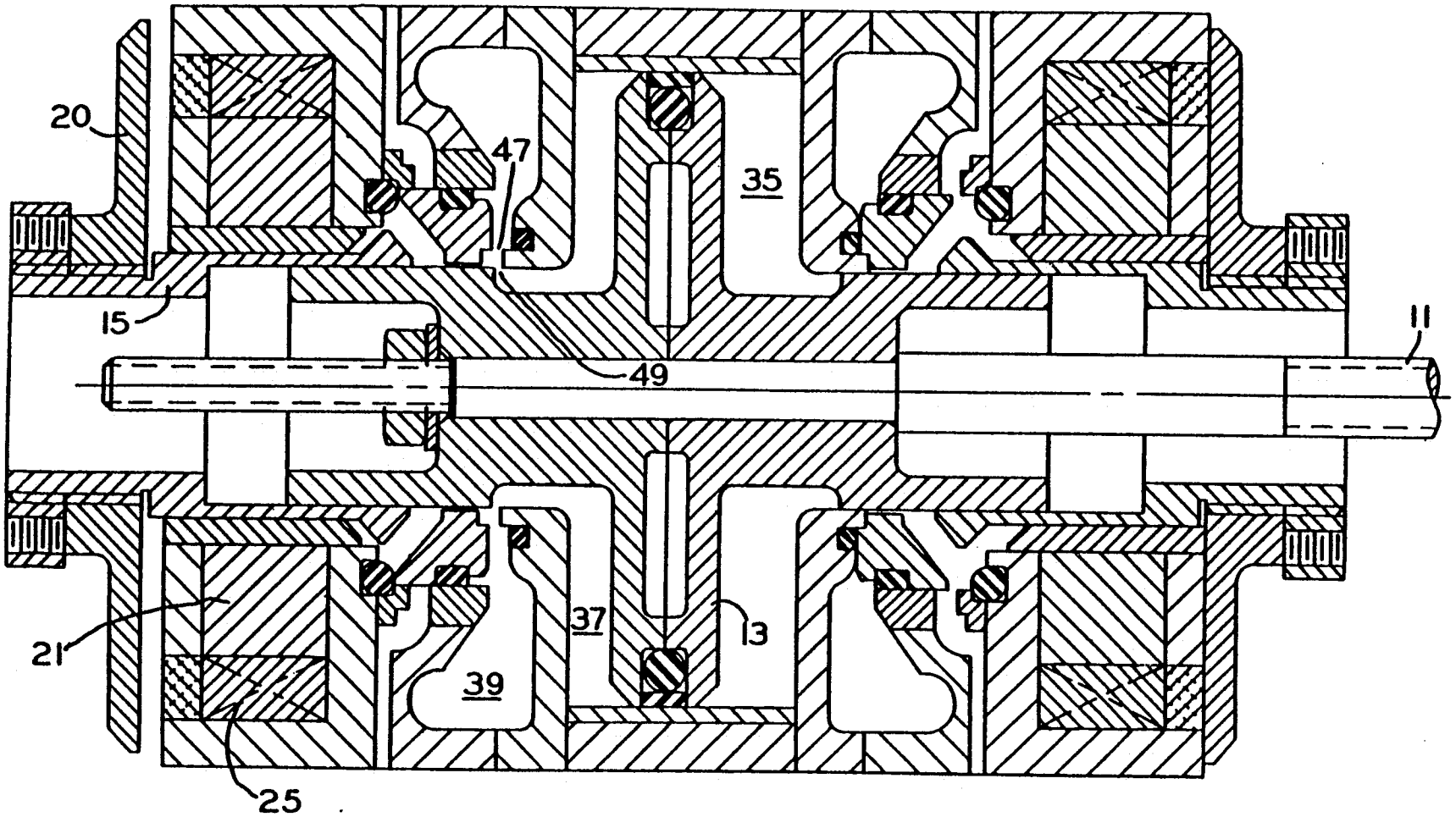
Figure 4:
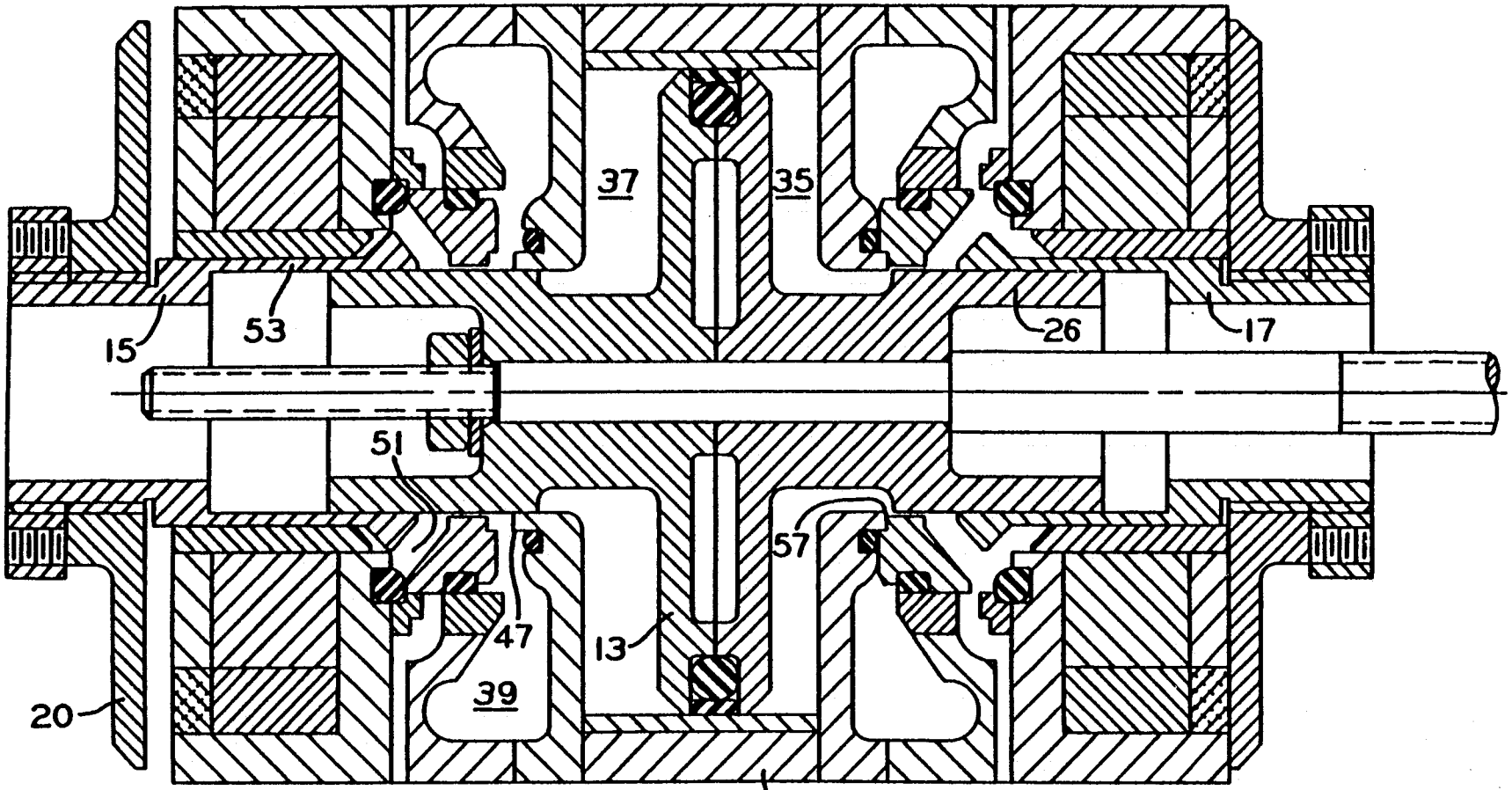
Figure 5:
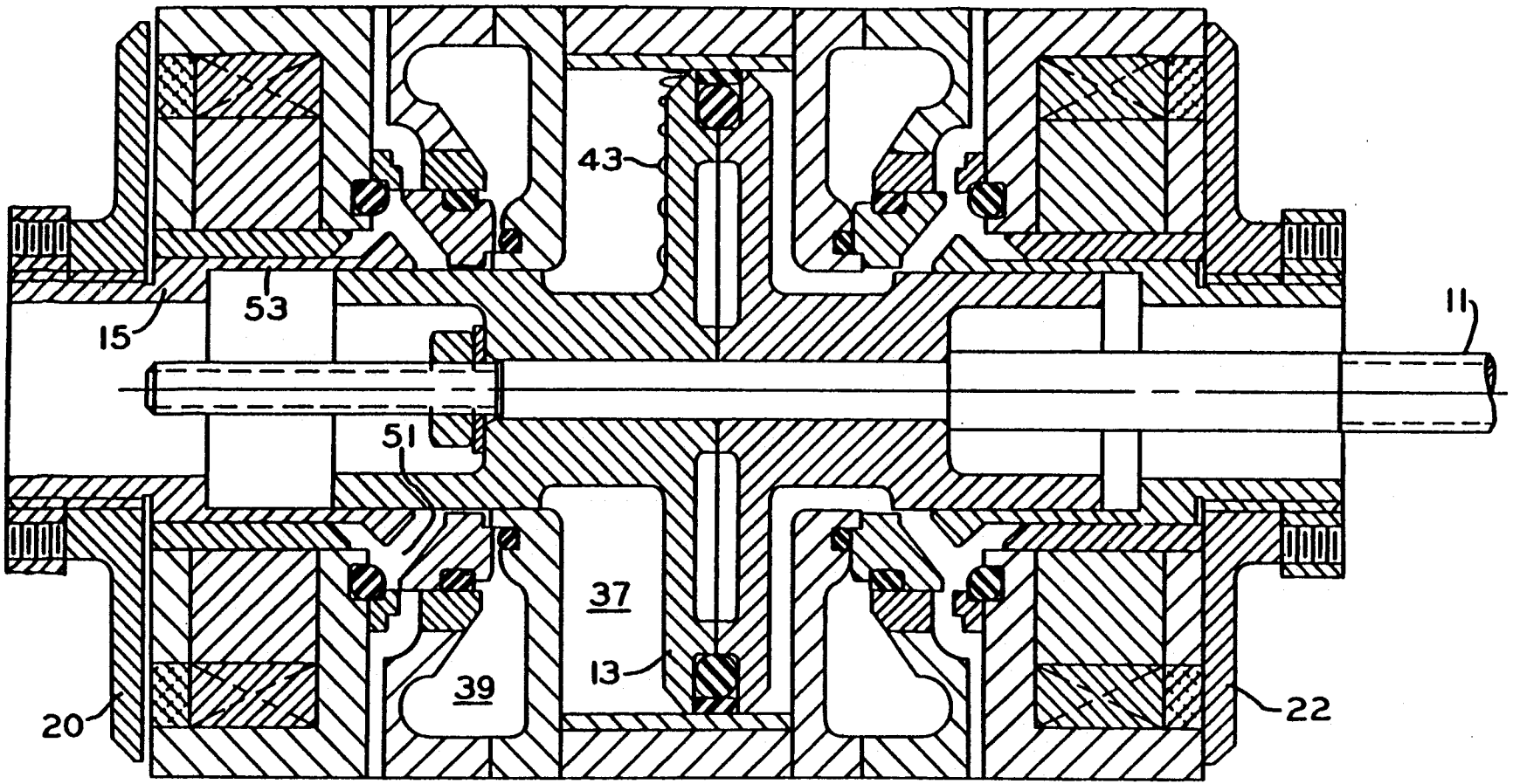
Figure 9:
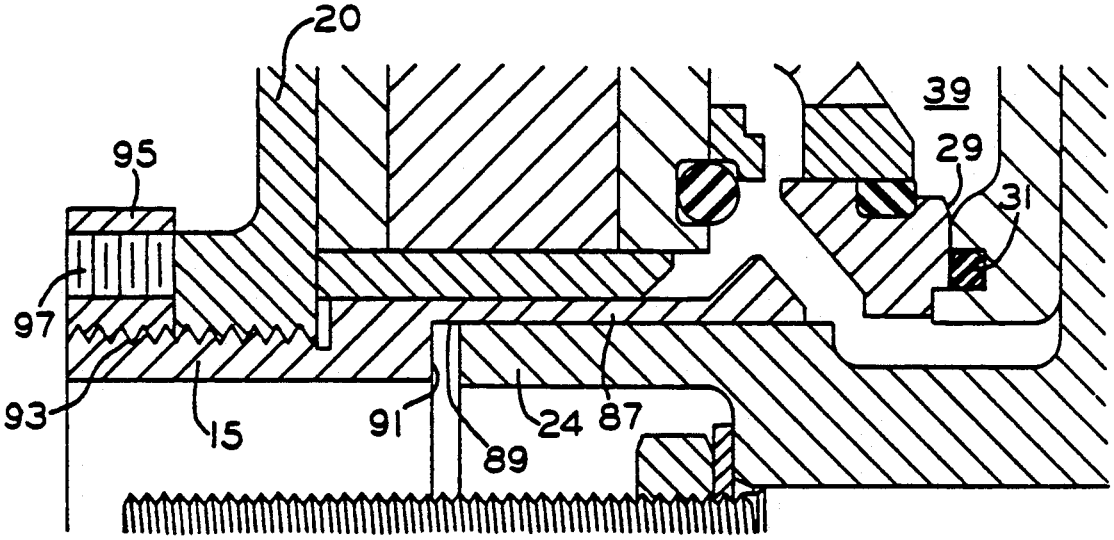
FIG. 9 is an enlarged sectional view of another portion of FIG. 1 illustrating the area limiting feature of the air control valve as well as the adjustable latch plate feature of the present invention.

FIG. 3 illustrates completion of this annular opening admitting high pressure air from chamber 39 into chamber 37 forcing the piston 13 rapidly toward the right. As the piston 13 continues its rightward motion, edge 49 cooperates with cylindrical end portion 24 (which is an enlarged subpiston portion of the piston 13) to close off the annular opening and remove the high pressure air supply from source 39 to chamber 37. This reclosure of the annular opening (as opposed to reclosure of the control valve 15 which does not happen until FIG. 6) is shown in FIG. 4. The piston 13 now moves as the air in chamber 37 continues to expand until further rightward movement of the piston as depicted in FIG. 5, uncovers the partial annular apertures 43 leading to intermediate pressure port so that the high pressure air in chamber 37 begins to blown down to the intermediate pressure. Also in FIG. 4, it will be noted that while the high pressure source 39 is no longer supplying air to drive the piston 13, the high pressure is maintained in chamber 51 so that the effective pressure differential is only that acting on annular area 53. While the air control valve 15 has begun to close in FIG. 5, the pressure in chambers 39 and 51 is substantially the same and when, in FIG. 6, the chamber 51 is vented to atmosphere, the area exposed to the high pressure is reduced back to surface 29 as depicted in FIGS. 1 and 9.

Beginning with FIG. 3, the piston 13 has closed the intermediate or "latching" pressure apertures 43 and the air captured in chamber 35 is being compressed to dampen or slow the piston motion. In FIGS. 4 and 5, a portion of this pressure is being slowly released as shown in FIG. 8*a*, while in going between FIGS. 6 and 7 the remaining pressure is suddenly removed in the manner depicted in FIG. 8*b*.

Figure 8A:
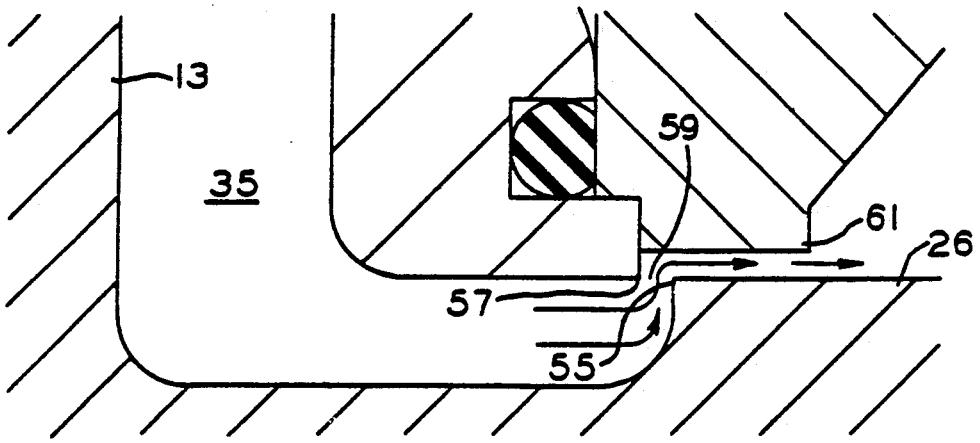
FIGS. 8*a* and 8*b* are enlarged sectional views of a portion of FIGS. 4 and 6 respectively illustrating the two stage release of damping pressure.
Figure 8B:
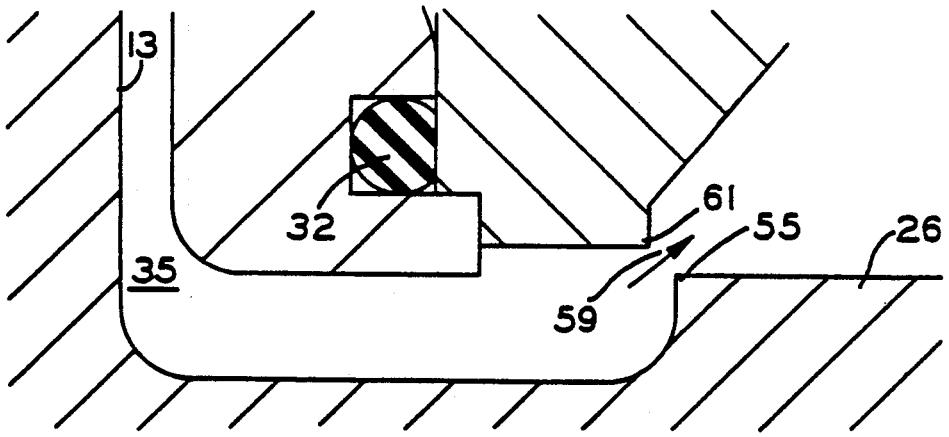

FIGS. 4 and 8*a* show the corner 55 of subpiston segment 26 just after it clears the corner 57 of housing 19. These corners are much more easily seen in the enlarged view of FIG. 8*a*. Prior to this time, the pressure in chamber 35 has been increasing rapidly. An annular opening is just beginning to form at 59 between the abutting corners 55 and 57. This annular opening slowly vents the high pressure air from chamber 35 as the piston continues its rightward journey to more gradually slow the piston motion as it approaches its right hand resting position. As shown in FIGS. 6 and 8*b*, just prior to the piston reaching that righthand extreme position, the corner 55 clears corner 61 and the heretofor small annular opening 59 becomes large allowing the remaining superatmospheric pressure air to rapidly escape chamber 35 to help prevent any rebound of the piston 13 back toward the left. This two stage venting or blow-down provides a more gradual and more easily controlled deceleration of piston motion.

The main piston 13 has reached its righthand extreme in FIG. 7, the respective annular openings 59 and 63 are venting chambers 35 and 51 to low, essentially atmospheric, pressure and the piston 13 is held or latched in the position shown by the intermediate pressure in chamber 37 from the intermediate pressure source openings 43. The return or leftward piston motion from the position of FIG. 7 back to that of FIG. 1 upon energization of coil 23 follows essentially the same sequence of events as has been described and should be clear from the symmetry of the actuator.

The tasks of the magnets 21 and 23 are to hold the air control valves 15 and 17 in their closed positions until neutralized by energization of the corresponding one of the coils 25 or 27 and to reclose the control valves subsequent to actuation. These holding and restorative forces required of the magnets are determined primarily by the force exerted by the internal unbalanced air pressure acting on the corresponding control valve. That force is, in turn, proportional to the projected component of valve area 29 in a plane normal to axis 12 which is exposed to unopposed high pressure air within the actuator. A reduction in this effective area will result in a reduction in the required magnetic field, a reduction in the size and cost of the magnets, and a reduction in the required ampere turns required of the coil to neutralize that magnetic field. Such an area limiting feature is best understood by referring to FIG. 9. The area reduction is made possible by reducing the valve cross-sectional area where unbalanced air pressure problems will be experienced. Such an area decrease facilitates the latch plate adjustment feature to be discussed subsequently in conjunction with FIG. 10. The control valve of FIG. 9 includes a thin walled portion 87 having an inner cylindrical surface 89 which slidingly engaging a portion of one of the enlarged diameter cylindrical portions 24 of the armature. The inner cylindrical surface 89 includes an end portion 91 of enhanced strength and reduced inner diameter which is too small to receive the enlarged diameter cylindrical portion or subpiston 24 of the armature. The enlarged diameter cylindrical portion responds to or cooperates with the control valve motion to stop the supply of high pressure air to the piston at the appropriate time. The control valve 15 when in the open position is subjected to the pressure of the source of high pressure fluid over the cross-sectional area of the thin walled portion 87 of the control valve in a plane normal to the axis 12 so that the effective area subjected to high pressure air after the control valve has opened is minimized thereby minimizing the restorative force required of the permanent magnet in reclosing the control valve. The ratio of this smaller air (control) valve area exposed to the internal unbalanced high pressure is less than 25% of the area exposed to the internal balanced pressure.

In FIG. 9, the O-ring 31 is a resilient member which cooperates with and is deformed by the air control valve 15 to prevent the application of armature moving air pressure from chamber 39 to the chamber 37 when the air control valve is in the closed position. The amount of deformation of the resilient member 31 when the air valve is in the closed position may be adjustably selected by movement of the latch plate 20 along the threaded portion 93 of air control valve 15. The diameter reduction at ledge 91 leads to an enhanced strength region which is threaded at 93 to receive latch plate or armature 20 and a lock nut 95 threadedly engaging the control valve and abutting the latch plate. A plurality of threaded fasteners such as set screw 97 pass transversely through the lock nut 95 and into locking engagement with the latch plate 20. The latch plate abuts the housing when the control valve is closed and functions as a member movable with the control valve for limiting control valve motion toward the seal. The threaded coupling between the member 20 and the air control valve provides for presetting the force applied to the seal by the air control valve. Prior to the present invention, this pressure was set by a trial and error technique of putting shims between the latch plate and a shoulder on the actuator body. Such a time consuming shim technique did not allow for matching the differential seal pressure to any variations in source pressure nor to variations in the delatching pulse driver energy levels.

Figure 10A:
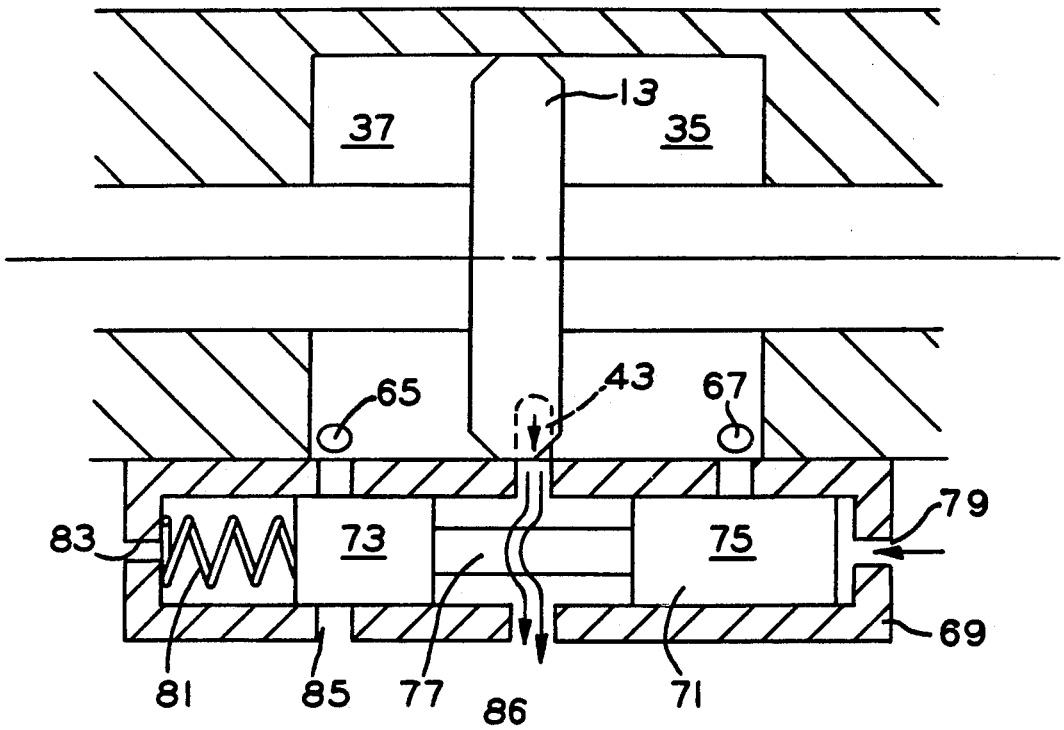
FIGS. 10*a* and 10*b* are enlarged sectional views of a further portion of FIG. 1 illustrating initialization of the valve actuating mechanism.
Figure 10B:
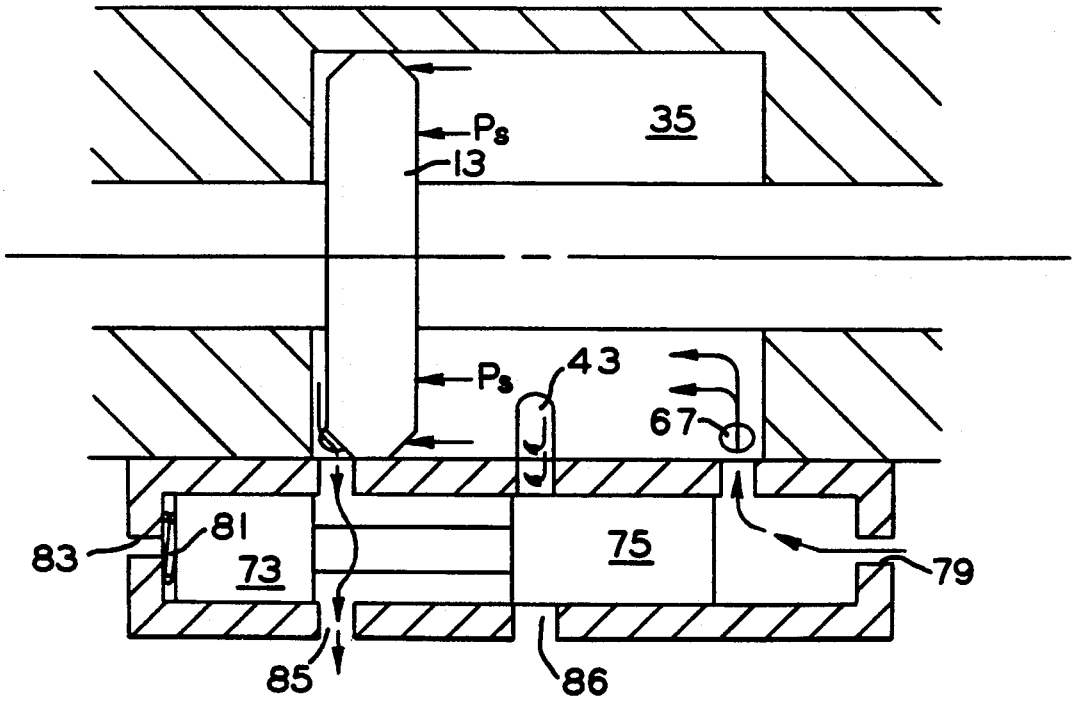

In rare cases, the actuator may have the piston resting in other than one of its extreme positions. An initializer as shown in FIG. 10*a* and 10*b* is a device used to preposition the actuator piston in either of the extreme positions regardless of what intermediate position in which the piston might happen to be. The initializer may be used to obtain a desired initial position for the engine poppet valve (either open or closed) preparatory to starting the engine or at other times when it is desired to reset the valve to an open or closed position. Initialization is accomplished by three distinct actions. The source pressure is supplied to one of the chambers 35 or 37, i.e., to one face of the piston 13. The air which might otherwise be trapped in the other of the chambers 35 or 37 is vented to atmosphere. The centrally located intermediate pressure ports 43 must not be allowed to vent high pressure air from the cylinder and are somehow temporarily blocked.

In FIG. 10*a*, the initializer is in its non-actuated position while in FIG. 10*b*, is activated. The initializer is fastened as by bolts to one side of an actuator. The actuator includes openings 65 and 67, to adapt it to the initializer. The initializer comprises a cylinder 69 and a control piston 71 having first and second ends 73 and 75 and a reduced diameter intermediate section 77 movable within the cylinder. Application of high air pressure through inlet 79 to the first end 75 moves the control piston against the bias of spring 81 from its inactive position as shown in FIG. 10*a*, to an initializing position of FIG. 10*b*. The control piston cylinder 69 is ported to atmosphere at 83 and 85 and to establish pneumatic communication between the high pressure air and one side of said power piston at 79. The piston portion 75 is effective to seal off the intermediate air pressure path from the power piston 13 cylinder via 43 and 86 when it is in the initialized position. The control piston 71 is urged by spring 81 to a return position upon removal of said high pressure air from end 75 and in the returned position, the piston effectively seals the high pressure air inlet 67 and the low pressure air outlet 65 while unsealing the intermediate air pressure path 43–86 from the power piston cylinder. As illustrated, the initializer moves the power piston to its leftmost location which would typically correspond to the engine valve being closed. To configure a particular actuator to always move the engine valve to an open position, the initializer is merely fastened to the side of the actuator end-for-end from the orientation shown. Like spacing of openings such as 65 and 67 will facilitate this reversibility.

Figure 11:
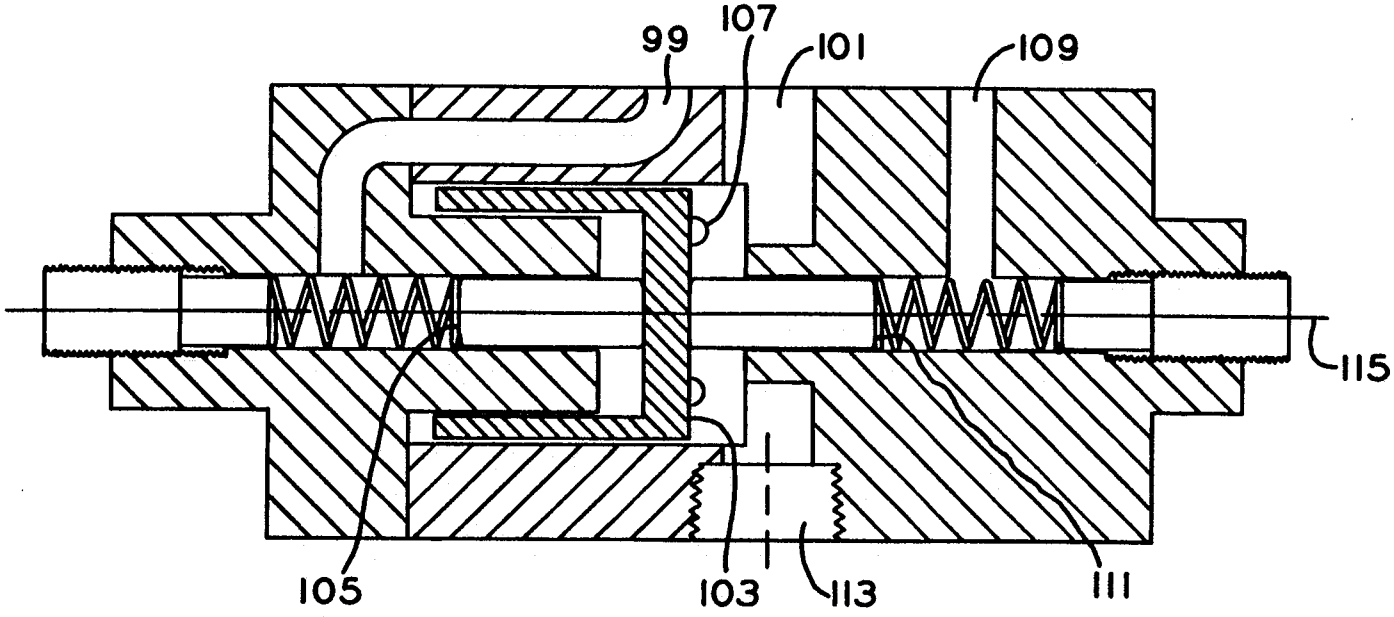
FIG. 11 is a view in cross-section of a differential pressure regulator in accordance with the invention in one form.
Figure 12B:
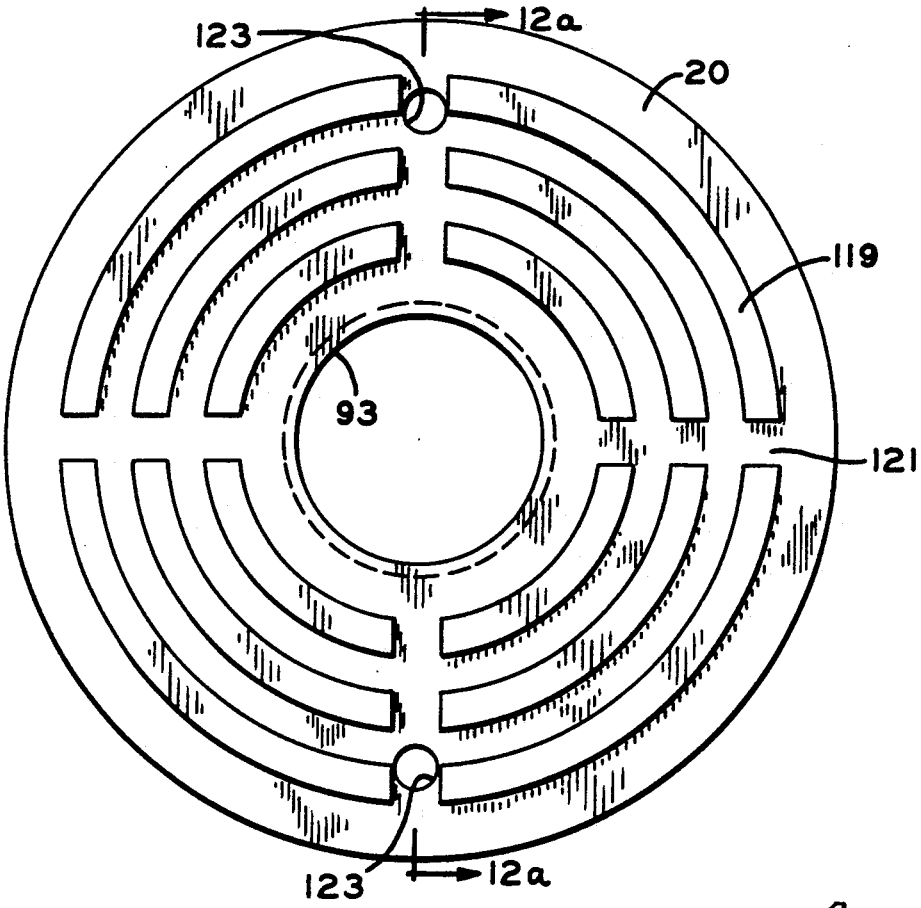
FIGS. 12*a* and 12*b* are orthogonal views, one in cross-section, of the flux transmitting surface of a modified control valve latch plate according to the present invention.
Figure 12A:
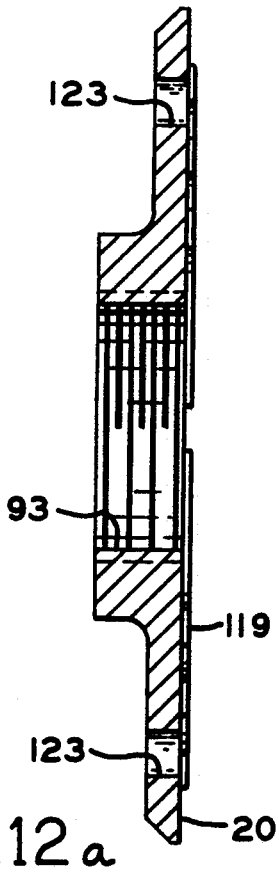

In FIG. 11, a differential pressure regulator for maintaining the ratio of the high air pressure (in chamber 39) to the intermediate or latching air pressure (the initial damping pressure at ports 43) constant is shown. When this ratio is maintained nearly constant despite variations in the pressure of the high pressure source, then critical damping of piston motion can also be maintained. The bistable actuator of the present invention has a piston which is held in either of its extreme positions by a latching air pressure and when commanded to change states, it does so by applying a high line pressure in opposition to the latching pressure, i.e., to the opposing face of piston 13. During the change of state, the latching force is overcome causing a slight increase in the latching pressure and an escape of air through the apertures 43. When ports 43 are closed by piston movement, the captured gas provides a stopping force which, if properly controlled in level as a function of time, can critically damp the piston motion. Critical damping depends on the correct damping air pressure at the time the openings 43 are closed relative to the applied high pressure which is driving the piston. For example, an increase in high pressure means the piston is being driven harder, is moving faster, and requires a greater retarding force to be stopped. An increase in intermediate air pressure will provide such an increase in the retarding force. A constant ratio between the source and latching pressures and rapid pressure regulator response time on the same order as the actuation time of the actuator have been found to be highly desirable.

In FIG. 11, the high pressure line connects to port 99 while the intermediate or latching pressure is present at port 101. For example, if it is desired to maintain a ratio of 10:1, the area of the annular piston surface 103 would be ten times the area of piston 105 and with a source pressure of 100 psi. The pressure at port 101 would be 10 psi. If source pressure were to drop to, e.g., 90 psi., the force on piston face 105 would decrease and piston 103 would move to the left increasing the opening of the outlet 107 and increasing the air flow out of opening 107 until the pressure at port 101 decreases to a value 1/10 of 90 psi. which is 9 psi. At that time the opposing forces would again be balanced. Also, as shown in FIG. 11, an accumulator can be connected to threaded opening 113 in order to provide a means of damping the pressure pulses inside the regulator.

The regulator of FIG. 11 is coupled to each of the source pressure 99, an intermediate pneumatic pressure 101 higher than said initial damping pressure, to an accumulator at 113, and to an exhaust pressure at 107 (frequently atmospheric pressure) which is lower than the initial damping pressure. The regulator senses instantaneous source pressure and continuously balances the intermediate pressure and exhaust pressure to obtain an instantaneous initial damping pressure that will provide the desired ratio. The regulator has a regulating piston reciprocable along an axis 115 and having a first surface 103 which is subjected to intermediate pressure to drive the regulating piston in one axial direction and a second surface 105 subject to source pressure to drive the piston in the opposite axial direction against the force on the first surface. The first surface area is a predetermined amount larger than the second surface area with that predetermined amount being chosen so that the regulating piston will move in the first axial direction (left as viewed) to admit the exhaust pressure at 107 to the atmosphere. This will decrease the initial damping pressure at 101 when the force on the first surface is greater than the force on the second surface until the force on the second surface moves the regulating piston in the second axial direction to seal the exhaust pressure from the atmosphere and to increase the initial damping pressure, thereby continuously maintaining the predetermined ratio between the initial damping pressure and the source pressure as determined by the ratio of the first surface area to the second surface area. The opening 109 is typically a vent to atmospheric pressure, but may provide for adjusting the predetermined ratio by applying a variable pneumatic bias pressure to the surface 111.

In FIGS. 1–7 the ferromagnetic latch plate or armature 20 appears to rest directly on the ferromagnetic pole pieces 115 and 117. The latch plate may be held very tightly in this position for two reasons. With no air gap between these two parts, the path reluctance is quite low, the flux quite high and the parts may be driven into magnetic saturation. Whatever lubricating medium the system employs will eventually find its way onto the latch plate surface which faces the actuator and pole pieces. The surface tension of the lubricant will significantly increase both the force and the variability of the force required to separate the two parts. Such variability introduces variations in opening time and required damping. The flux could be reduced by using a smaller magnet, but then the required force at a distance to reclose the control valve would be lacking. Saturation could be reduced or eliminated by utilizing additional iron, but this creates a slower heavier and more costly device. The introduction of a nonmagnetic gap when the members are closed on one another will solve the magnetic problems and such a gap with air passageways will reduce the lubricant surface tension problems.

To reduce the surface tension and to reduce the magnetic holding force on the latch plate 20, a nonmagnetic surface of, for example, brass 0.015 inches in thickness is created to space at least part of said flux transfer surface of the plate from the flux transmitting surface of the pole pieces 115 and 117 when the control valve 15 is in the closed position whereby the magnetic flux between the surfaces is measuredly decreased in the closed location so that the force required to overcome the attraction between the surfaces is substantially decreased and any liquid surface tension due to any lubricating liquid residues when the surfaces are in contact is minimized. The spacing arrangement is best seen in FIGS. **12*a* and 12b. The spacing arrangement includes at least one arcuate rim such as 119 extending from one of the flux transmitting and flux transfer surfaces and abutting the other of the surfaces when the control valve is in the closed location. As illustrated, a plurality of concentric circular arcuate rims are spaced from one another along a radius common to all the circular rims. A slot such as 121 is formed in the surface and across the rim for providing liquid passage for liquids collected and contained along and adjacent the rim. An opening such as the hole 123** is also provided in liquid communication with each of the slots to provide a liquid drain for any liquid in any of the slots. As shown, there are two openings and four arcuately equispaced radial slots each in liquid communication with the openings.

Little has been said about the internal combustion engine environment in which this invention finds great utility. That environment may be much the same as disclosed in the abovementioned copending applications and the literature cited therein to which reference may be had for details of features such as electronic controls and air pressure sources.

From the foregoing, it is now apparent that a novel electronically controlled, bistable pneumatically powered valve actuator has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An electronically controllable pneumatically powered valve actuating mechanism for use in an internal combustion engine of the type having engine intake and exhaust valves with elongated valve stems, the actuator comprising:

a power piston reciprocable along an axis and adapted to be coupled to an engine valve;

pneumatic motive means for moving the piston, thereby causing an engine valve to move in the direction of stem elongation between valve-open and valve-closed positions, the pneumatic means including a pair of control valves movable relative to the piston for selectively supplying high pressure air to the piston, and source pressure means for providing pneumatic source pressure for moving said piston; and pneumatic damping means for imparting an initial pneumatic damping pressure to said power piston to decelerate the piston when said engine valve reaches a predetermined separation from one of said valve-open and valve-closed positions, said initial pneumatic pressure being increased over a predetermined deceleration movement of said piston;

said pneumatic damping means including regulator means for maintaining a predetermined ratio between said source pressure and said initial damping pressure.

2. The electronically controllable pneumatically powered valve actuating mechanism of claim 1 wherein the regulator means is coupled to each of said source pressure means, an intermediate pneumatic pressure higher than said initial damping pressure and lower than said source pressure, and an exhaust pressure lower than the initial damping pressure; said regulator means sensing instantaneous source pressure and continuously balancing said intermediate pressure and said exhaust pressure to obtain an instantaneous initial damping pressure that will provide said ratio.

3. The electronically controllable pneumatically powered valve actuating mechanism of claim 2 wherein the regulator means comprises a regulating piston reciprocable along an axis and having a first surface subject to said intermediate pressure to drive said regulating piston in one axial direction and a second surface subject to said source pressure to drive said piston in the opposite axial direction against the force on the first surface; said first surface area being a predetermined amount larger than said second surface area, the predetermined amount being chosen so that said regulating piston will move in said first axial direction to admit said exhaust pressure to said intermidiate pressure to decrease said initial damping pressure when the force on said first surface is greater than the force on said second surface until said force on said second surface moves said regulating piston in said second axial direction to seal said exhaust pressure from said intermediate pressure to increase said initial damping pressure, thereby continuously maintaining said predetermined ratio between said initial damping pressure and said source pressure as determined by the ratio of said first surface area to said second surface area.

4. The electronically controllable pneumatically powered valve actuating mechanism of claim 1 further comprising means for adjusting said predetermined ratio.

5. The electronically controllable pneumatically powered valve actuating mechanism of claim 4 wherein the means for adjusting comprises means for applying a variable pneumatic bias pressure to the first surface.

6. An electronically controllable pneumatically powered valve actuating mechanism for use in an internal combustion engine of the type having engine intake and exhaust valves with elongated valve stems, the actuator comprising:

a power piston reciprocable along an axis and adapted to be coupled to an engine valve;

pneumatic motive means for moving the piston, thereby causing an engine valve to move in the direction of stem elongation between valve-open and valve-closed positions, the pneumatic motive means including a pair of control valves movable relative to the piston for selectively supplying high pressure air to the piston; and pneumatic damping means for imparting a first decelerating force to the piston when the engine valve reaches a first separation from one of said valve-open and valve-closed positions to begin reducing engine valve velocity as the engine valve approaches said one position, and for imparting a second lesser decelerating force to the piston when the engine valve reaches a second lesser separation from said one position.

7. The electronically controllable pneumatically powered valve actuating mechanism of claim 6 wherein the pneumatic damping means comprises an annular abutment joining a first lesser diameter portion of the piston to a second larger diameter portion of the piston, and a cooperating annular abutment joining a first lesser inside diameter surface of the control valve to a second larger inside diameter surface of the control valve, piston motion near the one position compressing air and that compressed air slowly escaping through a small annular opening between the larger diameter portion of the piston and the lesser inside diameter surface of the control valve, axial passage of the annular abutment and cooperating annular abutment abruptly increasing the air escape path to one formed by the annular opening between the smaller diameter portion of the piston and the larger inside diameter surface of the control valve.

8. The electronically controllable pneumatically powered valve actuating mechanism of claim 7 wherein the second larger diameter portion of the piston is cylindrical and provides the main sliding seal confining the high pressure air supplied to the piston and the main sliding bearing which supports the piston.

9. The electronically controllable pneumatically powered valve actuating mechanism of claim 6 wherein the pneumatic damping means is effective to relieve the second decelerating force from the piston when the engine valve is very close to the said one position.

10. An electronically controllable pneumatically powered valve actuating mechanism for use in an internal combustion engine of the type having engine intake and exhaust valves with elongated valve stems, the actuator comprising:

a power piston reciprocable along an axis and adapted to be coupled to an engine valve, the power piston having a pair of spaced apart enlarged diameter cylindrical portions for providing a sliding seal for confining high pressure air supplied to the piston as well as providing a pair of sliding bearing surfaces for supporting the piston;

pneumatic motive means for supplying high pressure air to the piston causing the piston and valve to move in the direction of stem elongation between valve-open and valve-closed positions;

magnetic latching means including a control valve for rendering the pneumatic motive means ineffective; and means for releasing the magnetic latching means allowing the pneumatic motive means to move the control valve; and means including an enlarged diameter cylindrical portion of the power piston responsive to control valve motion to stop the supply of high pressure air to the piston.

11. The electronically controllable pneumatically powered valve actuating mechanism of claim 10 wherein the control valve includes an inner cylindrical surface slidingly engaging a portion of one of the enlarged diameter cylindrical portions of the power piston, the inner cylindrical surface including an end portion of reduced inner diameter which is too small to receive the enlarged diameter cylindrical portion of the piston.

12. An electronically controllable pneumatically powered valve actuating mechanism for use in an internal combustion engine of the type having engine intake and exhaust valves with elongated valve stems, the actuator comprising:

a power piston reciprocable along an axis and adapted to be coupled to an engine valve;

pneumatic motive means for moving the piston, thereby causing an engine valve to move in the direction of stem elongation between valve-open and valve-closed positions, the pneumatic means including a pair of control valves movable relative to the piston for selectively supplying high pressure air to the piston, and source pressure means for providing pneumatic source pressure for moving said piston;

a cylinder within which said power piston reciprocates; and initializing means coupled to said cylinder for providing an initializing movement of said piston to an initialized position of a selected one of a valve-open and valve-closed positions when said pneumatic motive means is inactive.

13. The electronically controllable pneumatically powered valve actuating mechanism of claim 12 further comprising intermediate pressure source means coupled to said cylinder for providing a source of damping pressure, said initializing means sealing off and unsealing said intermediate pressure source from said cylinder respectively during said initializing movement and after said initializing movement is completed.

14. The electronically controllable pneumatically powered valve actuating mechanism of claim 13 wherein the initializing means selectively applies high pressure air to one side of said power piston and low pressure air to the other side of the power piston to move said power piston to said selected one of the valve-open and valve-closed positions while the intermediate air pressure is sealed off.

15. The electronically controllable pneumatically powered valve actuating mechanism of claim 14 wherein the initializing means comprises a cylinder and a control piston having first and second ends and a reduced diameter intermediate section movable within the cylinder to an initializing position by application of high air pressure to said first end to move said control piston against spring bias; said control piston cylinder being ported to establish pneumatic communication between said high pressure air to said one side of said power piston and said sealing off of said intermediate air pressure from said power piston cylinder when said control piston is in said initialized position, said control piston being spring urged to a return position upon removal of said high pressure air from said one end of said control piston to seal said high pressure air and said low pressure air to said power piston side and unsealing said intermediate air pressure to said power piston cylinder.

16. An electronically controllable pneumatically powered valve actuating mechanism for use in an internal combustion engine of the type having engine intake and exhaust valves with elongated valve stems, the actuator comprising:

a power piston reciprocable along an axis and adapted to be coupled to an engine valve, the piston including enlarged diameter cylindrical portions near opposite ends thereof;

pneumatic motive means for moving the piston, thereby causing an engine valve to move in the direction of stem elongation between valve-open and valve-closed positions, the pneumatic motive means including a pair of control valves movable relative to the piston for selectively supplying high pressure air to the piston, each control valve including a thin walled portion having an inner cylindrical surface slidingly engaging a portion of one of the enlarged diameter cylindrical portions of the power piston, the inner cylindrical surface including an end portion of enhanced strength and reduced inner diameter which is too small to receive the enlarged diameter cylindrical portion of the power piston;

the enlarged diameter cylindrical portions cooperating with corresponding control valve motion to stop the supply of high pressure air to the piston;

a resilient member cooperating with and deformed by a corresponding control valve to prevent the application of piston moving air pressure to the piston when the control valve is in the closed position, and means for adjustably selecting the amount of deformation of the resilient member when the control valve is in the closed position; and pneumatic damping means for imparting a first decelerating force to the piston when the engine valve reaches a first separation from one of said valve-open and valve-closed positions to begin reducing engine valve velocity as the engine valve approaches said one position, and for imparting a second lesser decelerating force to the piston when the engine valve reaches a second lesser separation from said one position.

17. The electronically controllable pneumatically powered valve actuating mechanism of claim 16 wherein said pneumatic damping means including regulator means for maintaining a predetermined ratio between a high pressure air source pressure and an initial damping pressure.

18. The electronically controllable pneumatically powered valve actuating mechanism of claim 17 wherein the regulator means is coupled to each of the source pressure, an intermediate pneumatic pressure higher than said initial damping pressure and lower than the source pressure, and an exhaust pressure lower than the initial damping pressure; said regulator means sensing instantaneous source pressure and continuously balancing the intermediate pressure and exhaust pressure to obtain an instantaneous initial damping pressure that will provide said ratio.

19. The electronically controllable pneumatically powered valve actuating mechanism of claim 16 further comprising a cylinder within which said power piston reciprocates, and initializing means coupled to said cylinder for providing an initializing movement of said piston to an initialized position of a selected one of a valve-open and valve-closed positions when said pneumatic motive means is inactive.

20. The electronically controllable pneumatically powered valve actuating mechanism of claim 16 wherein each control valve carries an armature at one of its ends and further comprising:

magnetic latching means for engaging and magnetically holding said armature and closing and holding said control valve in a first location;

means for moving said control valve toward a second location against the holding force of said magnetic latching means;

said armature being of a magnetic material and having a flux transfer surface;

said magnetic latching means having a flux transmitting surface as least a portion of which is juxtaposed with at least a portion of the armature flux transfer surface when the control valve is in the first location;

said armature and said magnetic latching means being attracted toward one another and forced away from each other as said control valve moves from one location to the other;

spacing means to space at least part of said flux transfer surface from said flux transmitting surface when said valve is in said first location whereby the magnetic flux between said surfaces is measuredly decreased in said first location so that the force required to overcome the attraction between said surfaces is substantially decreased and any liquid surface tension due to any lubricating liquid residues when said surfaces are in contact is minimized.

* * * * *